US007303347B1

(12) United States Patent
Duncan

(10) Patent No.: US 7,303,347 B1
(45) Date of Patent: Dec. 4, 2007

(54) STAIN REMOVAL KIT

(76) Inventor: Georgetta P. Duncan, 1801 Huckleberry La., Prospect, KY (US) 40059

( * ) Notice: Subject to any disclaimer, the term of this patent is extended or adjusted under 35 U.S.C. 154(b) by 615 days.

(21) Appl. No.: 10/679,877

(22) Filed: Oct. 6, 2003

Related U.S. Application Data

(60) Provisional application No. 60/427,329, filed on Nov. 19, 2002.

(51) Int. Cl.

| | |
|---|---|
| ***A46B 11/00*** | (2006.01) |
| ***A46B 11/02*** | (2006.01) |
| ***A45D 33/00*** | (2006.01) |
| ***A47L 1/08*** | (2006.01) |
| ***B65D 69/00*** | (2006.01) |

(52) U.S. Cl. ..... 401/123; 401/126; 401/130; 401/16; 401/25; 401/188 R; 401/137; 206/223

(58) Field of Classification Search ..... 401/16, 401/23–25, 37–39, 118, 121, 122, 123, 124, 401/125, 126, 128, 129, 130, 188 R, 137; 206/223, 229

See application file for complete search history.

(56) References Cited

U.S. PATENT DOCUMENTS

| | | | | |
|---|---|---|---|---|
| 3,719,460 | A * | 3/1973 | Brockman | 451/461 |
| 4,522,523 | A * | 6/1985 | Vogelsang | 401/126 |
| 5,111,934 | A | 5/1992 | Morin | |
| 5,116,154 | A * | 5/1992 | Fulkerson | 401/127 |
| 5,765,407 | A | 6/1998 | Choo et al. | |
| 5,849,039 | A | 12/1998 | Sadlowski | |
| 5,897,262 | A * | 4/1999 | Bratby-Carey | 401/18 |
| 6,076,985 | A * | 6/2000 | Gueret | 401/122 |
| 6,244,773 | B1 * | 6/2001 | Geremia-Nargi | 401/195 |

* cited by examiner

*Primary Examiner*—David J. Walczak
(74) *Attorney, Agent, or Firm*—Theresa Fritz Camoriano; Camoriano & Associates

(57) ABSTRACT

A portable stain removal kit for removing stains from fabrics, such as clothing or furniture, for use immediately after the mishap has occurred. The kit is intended to be small enough to be carried in a pocket or purse and includes a spatula, a stain removing material, a brush, and an absorbent material.

17 Claims, 10 Drawing Sheets

STAIN REMOVAL KIT

This application claims priority from U.S. Provisional Application Ser. No. 60/427,329 filed Nov. 19, 2002.

BACKGROUND OF THE INVENTION

The present invention relates to a kit for removing stains from fabrics. More particularly, it relates to a portable, pocket-sized "first aid" kit for removing stains from fabrics such as clothing or furniture.

SUMMARY OF THE INVENTION

The present invention provides a portable, pocket-sized kit with tools to apply emergency cleaning to a limited area of fabric to treat and remove stains which may otherwise cure and permanently stain the fabric.

DESCRIPTION OF THE PREFERRED EMBODIMENTS

Figure 1:
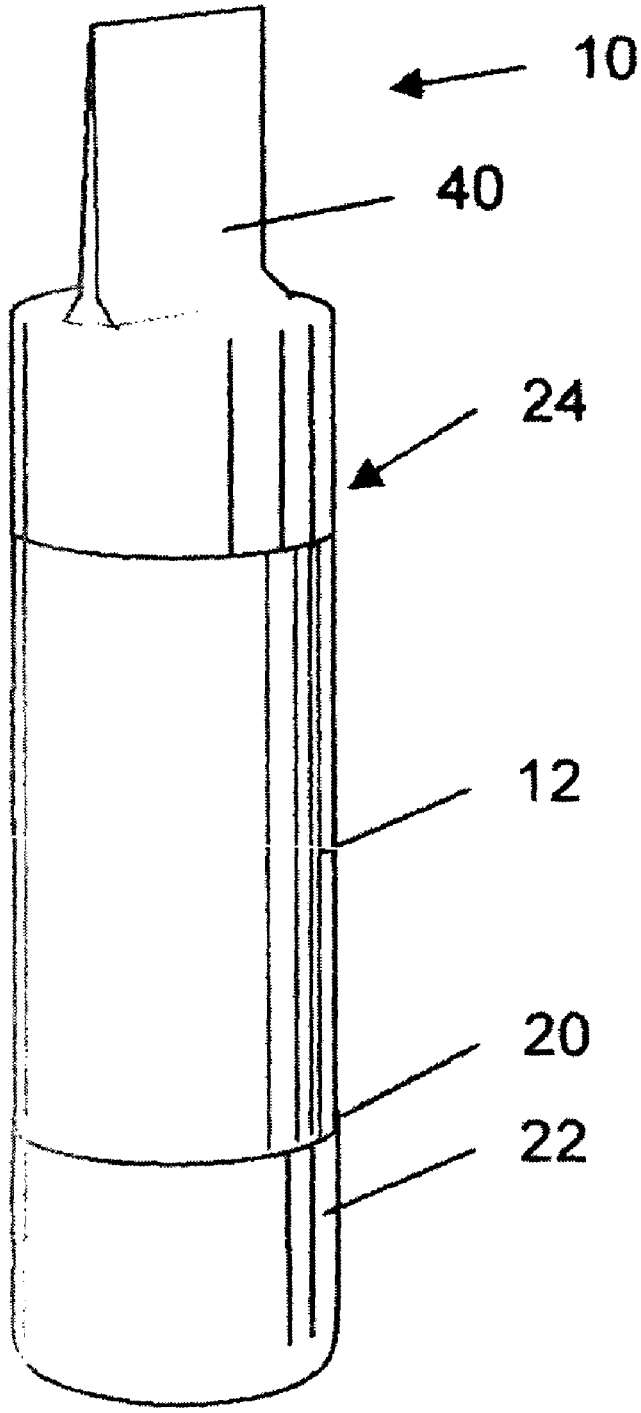
FIG. 1 is a perspective view of a stain removal kit made in accordance with the present invention.
Figure 2:
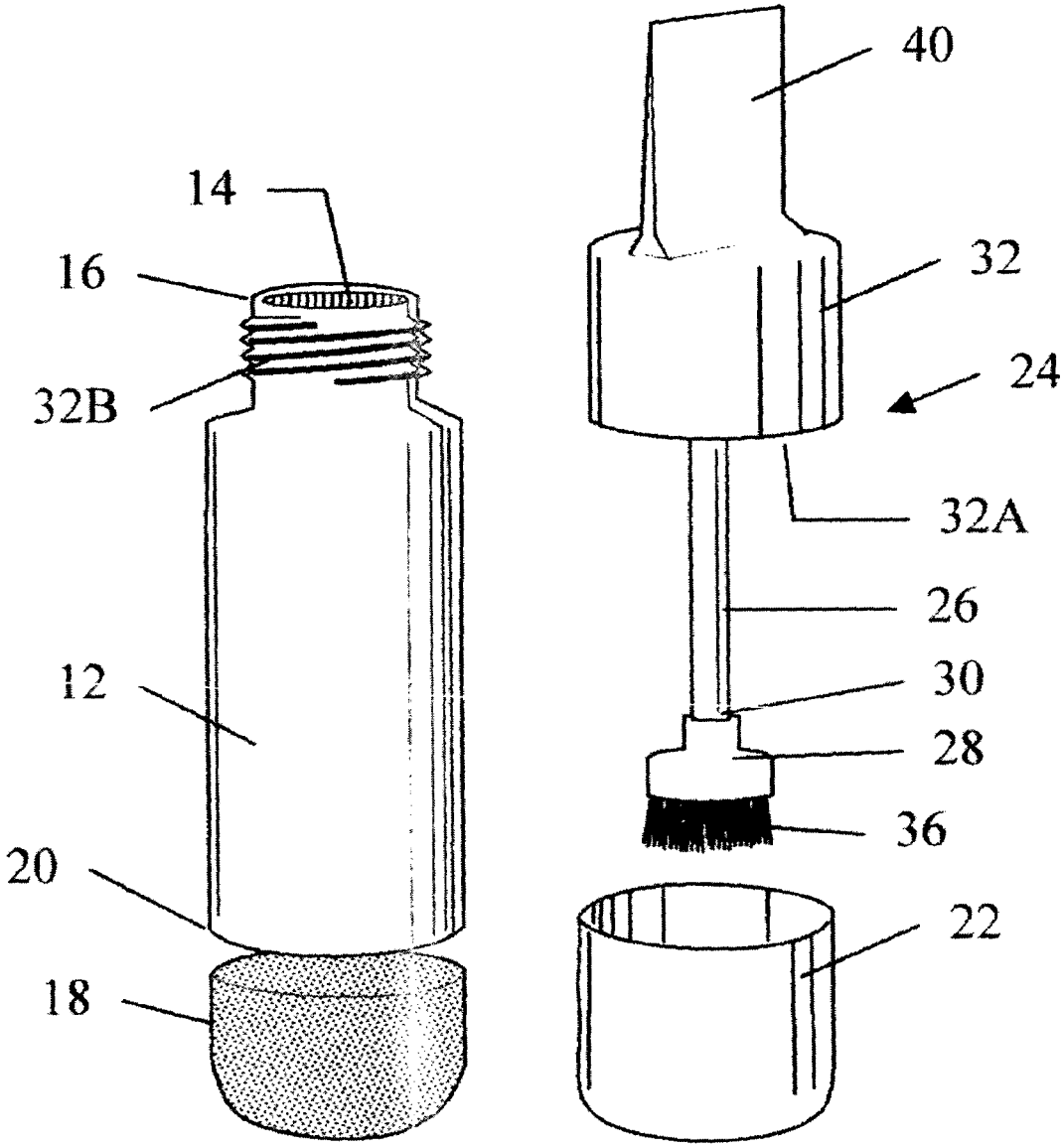
FIG. 2 is an exploded, perspective view of the stain removal kit of FIG. 1.
Figure 3:
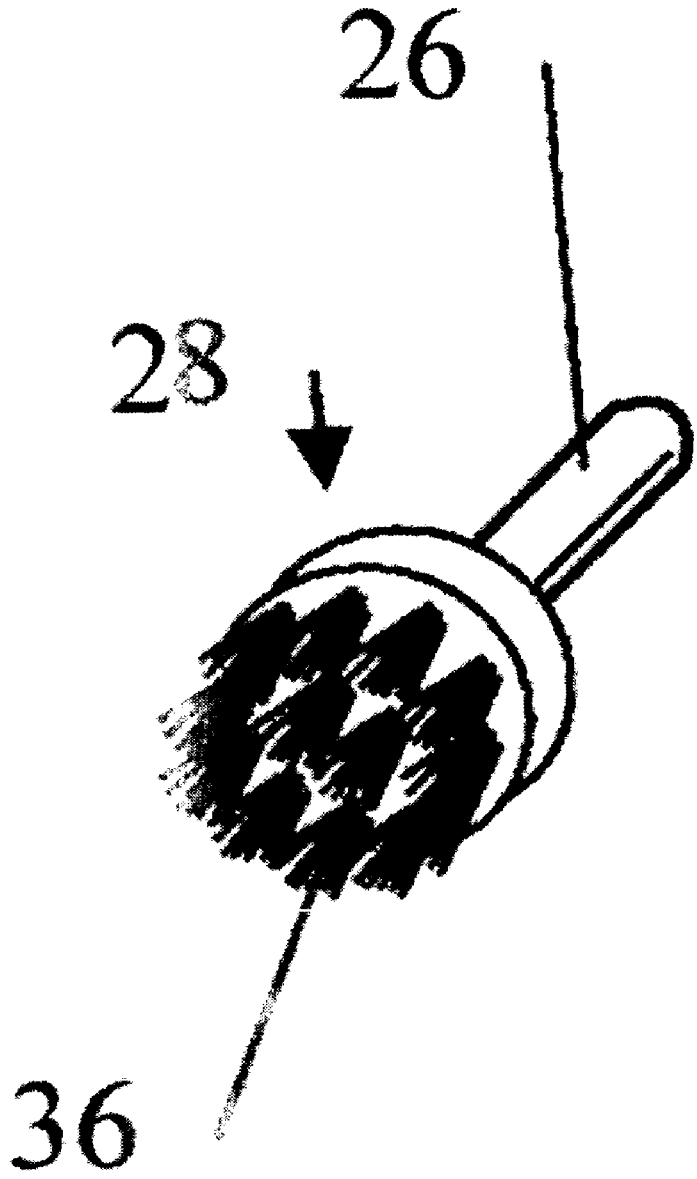
FIG. 3 is a perspective view of the stiff-bristled brush of FIG. 2.

FIGS. 1 and 2 depict a stain removal kit 10 made in accordance with the present invention. FIG. 1 shows the kit 10 assembled, as it would be carried in a pocket or purse, and FIG. 2 shows the kit disassembled for use. As illustrated in FIG. 2, the kit 10 includes an elongated, cylindrical container 12, an applicator tool 24, and a cap 22. The container 12 defines an internal cavity 14, which has a single opening at its top end 16. Attached to its bottom end 20 is a soft, absorbent material 18. The absorbent material 18 may be a sponge or a blotter, and this material 18 may be pre-moistened as part of the kit 10, or moisture, such as clean water, may be added as needed during the cleaning process. The cap 22 fits over the absorbent material 18 and snaps, screws, or is otherwise releasably retained onto the bottom end 20 of the container 12 to protect the absorbent material 18 until such time as it is needed. In this embodiment, the container 12 and caps 22, 32 serve as a housing, holding together all the components of the kit. The applicator tool 24 is an elongated member defining a stem 26 with a brush 28 at its bottom end 30, and a cap 32 and a spatula 40 at its top end. The brush 28 includes a plurality of stiff bristles 36 (See also FIG. 3), which are used to apply a detergent or stain remover onto the stain and to work it into the fabric to dislodge the stain. The cap 32 has internal threads 32A, and the container 12 has mating external threads 32B, which allows the applicator tool 24 to be inserted into the container 12 with the bristles 36 down, and the cap 32 to be threaded into the container 12. Since the container 12 contains a detergent or stain remover, the cap 32 seals the container 12, so it will not leak when it is being carried or stored. Alternatively, the cap 32 may snap onto the container 12 or otherwise be secured in a known method that will not allow leakage of the cleaning material from inside the container 12. Since the absorbent material 18 is attached to the bottom of the container 20, it is mounted by a mounting means that keeps it out of contact with the cleaning material that is inside the container as the cleaning material is being dispensed by the applicator brush 28.

When the cap 32 is installed at the top end 16 of the container 12, the stem 26 and the brush 28 extend into the cavity 14. Inside the cavity 14, a detergent or other stain removing material (not shown) is stored. The detergent or stain remover material is preferably in a liquid form, but it may be a solid, including various solid forms, such as a gel or powder, or it may be in other known forms as well. Various types of stain dissolving materials are known, including detergents, soaps, various solvents, and so forth.

In the event of a spill onto the person's clothing or other fabric, such as an upholstered chair, the user may use the "first aid" stain removal kit to remove the stain from the fabric. First the spatula 40 may be used to scrape off any excess of the spilled material off of the fabric, being careful not to spread the stain any more than it already has spread. Next, the cap 32 is removed, and the brush 28 is pulled out of the cavity 14 which also contains the stain remover material. The stain remover material then may be applied directly onto the stain, or the brush 28 may be used to apply it onto the stain. The stain remover material is then worked into the fabric with the aid of the stiff bristles 36 of the brush 28, preferably with a rotary motion so as not to diffuse the stain. It may be advantageous to place a napkin, handkerchief, or other absorbent material on the other side of the fabric being cleaned to help draw the detergent/stain remover through the fabric, taking the stain with it. Finally, the lower cap 22 is removed to expose the absorbent material 18, which is then dabbed onto the fabric to finish removing the stain. The absorbent material 18 may be dry to aid in drawing out the detergent/stain remover, together with the stain, off of the fabric, or it may be pre-moistened (or moisture such as clean water may be added to the absorbent material 18) to aid in cleaning off the stain from the fabric.

In a preferred embodiment, the stain removal kit 10 may be made out of any suitable material, such a plastic, preferably measuring approximately between 2 and 3 inches in length by approximately one inch in diameter. The bristles 36 of the brush 28 are also preferably made of stiff plastic fibers with a length of less than 0.5 inches. The material of the container 12 may be any material suitable for the task, such as metal, glass, or plastic. The shape of the container may be other than cylindrical in nature, for instance, it may have a curved shape like that of a perfume bottle.

Figure 4:
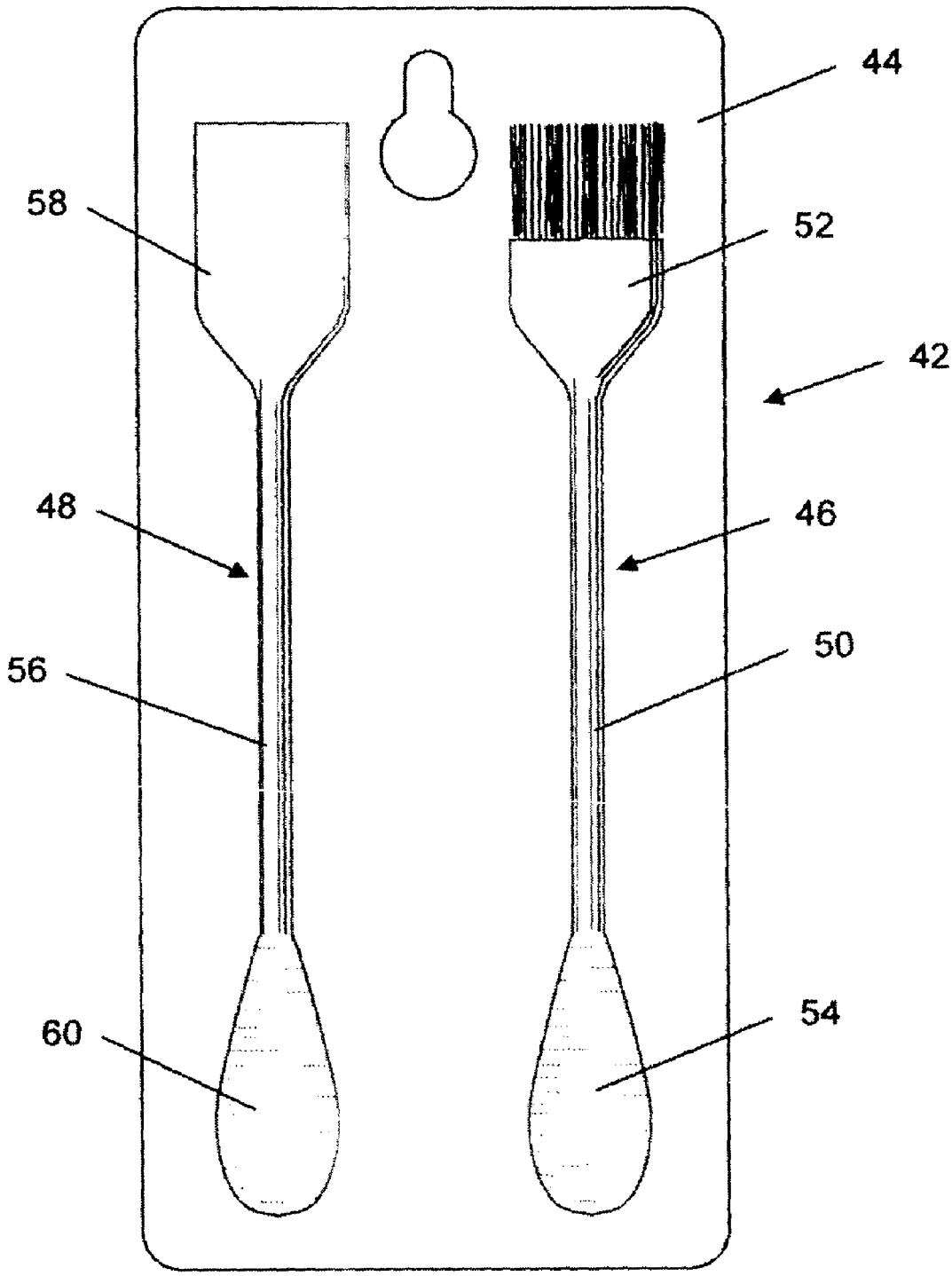
FIG. 4 is a plan view of another embodiment of a stain removal kit made in accordance with the present invention.

FIG. 4 depicts another embodiment of a stain removal kit 42 made in accordance with the present invention. This kit 42 is housed in a blister package 44, to make it convenient to display and sell, for example, out of automated vending machines found in restrooms, rest stops, etc., or hanging on a hook in a shop. (Of course, any of the kits shown here may be packaged for sale in an automated machine or for hanging on a hook, if desired.) This particular blister package is about three inches long, about 1.5 inches wide, and about ¼-inch thick.

The kit 42 includes two elongated members 46, 48. The first member 46 includes a stem 50, with a stiff-bristled brush 52 at its first end and a cotton swab 54 at its second end. The second member 48 includes a stem 56 with a spatula or scraper tool 58 at its first end and a cotton swab 60 at its second end. Preferably, one of the cotton swabs 54 or 60 is impregnated with stain remover, while the other swab is dry. The swab that is impregnated with stain removing material preferably has a distinct color, such as green or blue, to indicate that it contains the stain remover, while the other swab preferably is white or off-white, indicating that it does not contain the stain remover. The blister-pack packaging may provide a sufficient seal that the detergent-impregnated swab may be stored in a wet condition, or the stain remover-impregnated swab may be stored in a dry form which may be moistened by the user prior to use.

To use this kit 42, the user opens the packaging 44 and removes the tools 46, 48. The spatula 58 is used to remove excess spilled material off of the fabric. The cotton swab 54 or 60, which is impregnated with the stain remover, is used to apply the stain remover to the stain, and the brush 52 is used to work the stain remover material into the fabric to dislodge the stain. Again, a napkin, handkerchief, towelette, or other piece of absorbent material may be placed under the stained area to help draw the stain remover and the stain off of the fabric. Such a towelette may be provided as part of the kit and be housed inside the blister pack 44, if desired. Finally, the other swab is used to remove the detergent and any remaining stain from the treated area.

Figure 5:
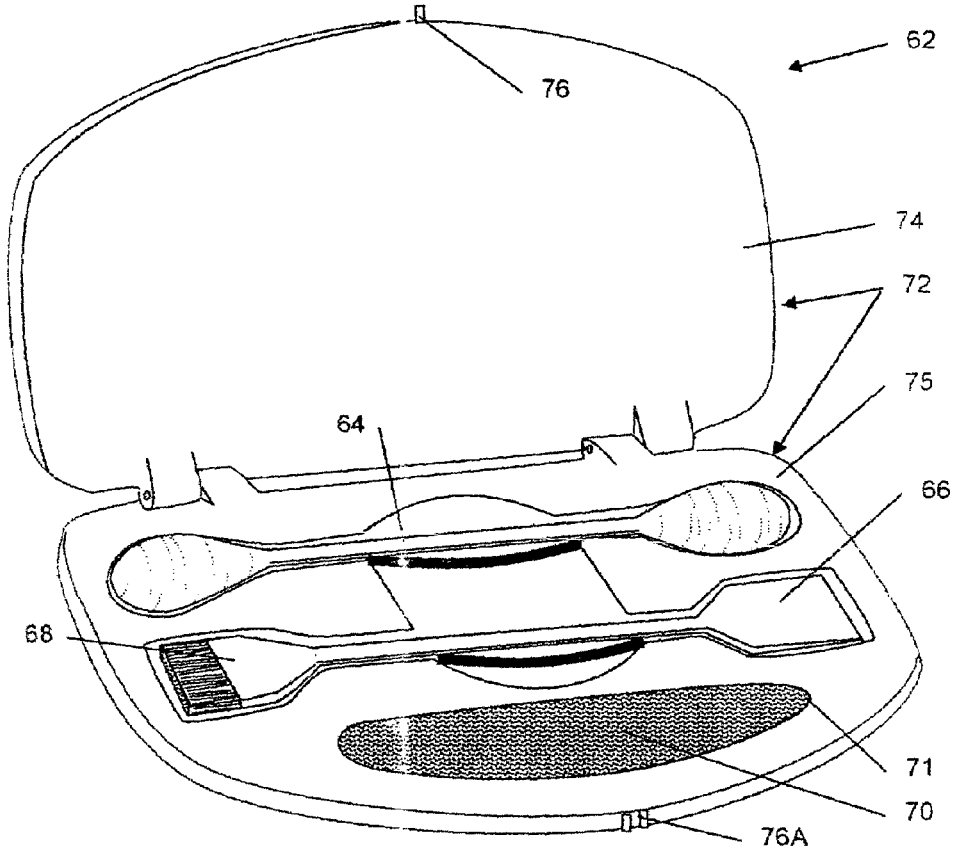
FIG. 5 is a perspective view of another embodiment of a stain removal kit made in accordance with the present invention.

FIG. 5 depicts another embodiment of a stain removal kit 62 made in accordance with the present invention. This kit 62 includes a carrying case 72, similar to a lady's compact for make-up, which serves as a housing to house the components of the kit. This carrying case 72 is approximately four inches long, two inches wide, and one-half inch thick. The carrying case 72 houses a double-tipped cotton swab 64 and a tool 67 having a spatula 66 at one end and a stiff-bristled brush 68 at the other end. The case 72 also defines an internal recess 71, which holds a supply of dry stain remover 70. The carrying case 72 includes a base 75 and a hinged lid 74. The lid 74 has a first locking clasp portion 76, and the base 75 has a second locking clasp portion 76A, allowing the lid 74 and base 75 to be closed with a snap fit.

The stain remover 70 is preferably in a soft, solid form, similar to solid under-arm deodorant or in a compacted powder form similar to compact make-up. One of the tips of the cotton swab 64 is used to apply the detergent/stain remover onto the stain, while the other tip is used for final clean-up and absorption of the materials in the treated area as discussed in reference to previous embodiments.

Figure 6:
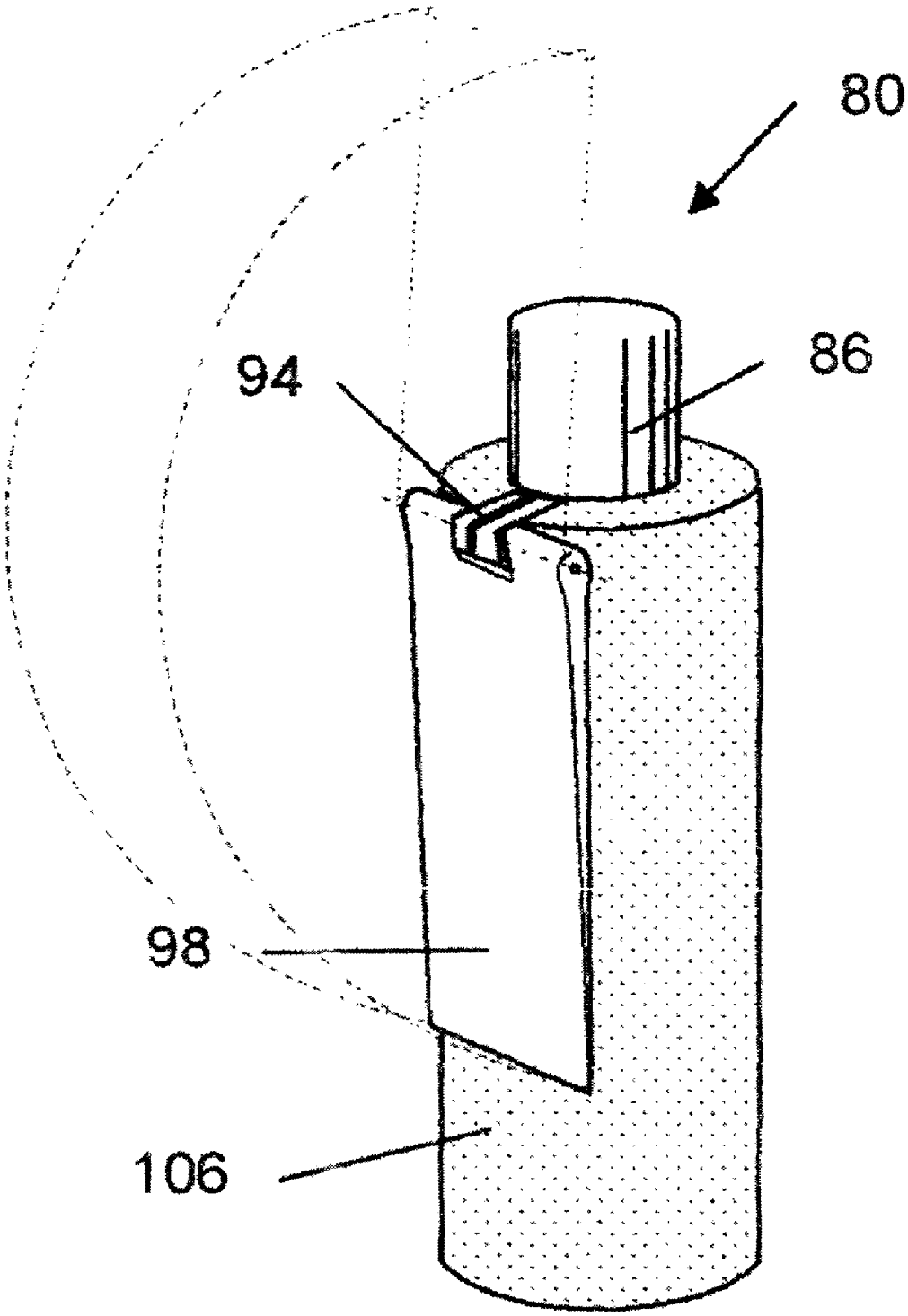
FIG. 6 is a perspective view of another embodiment of a stain removal kit made in accordance with the present invention.
Figure 7:
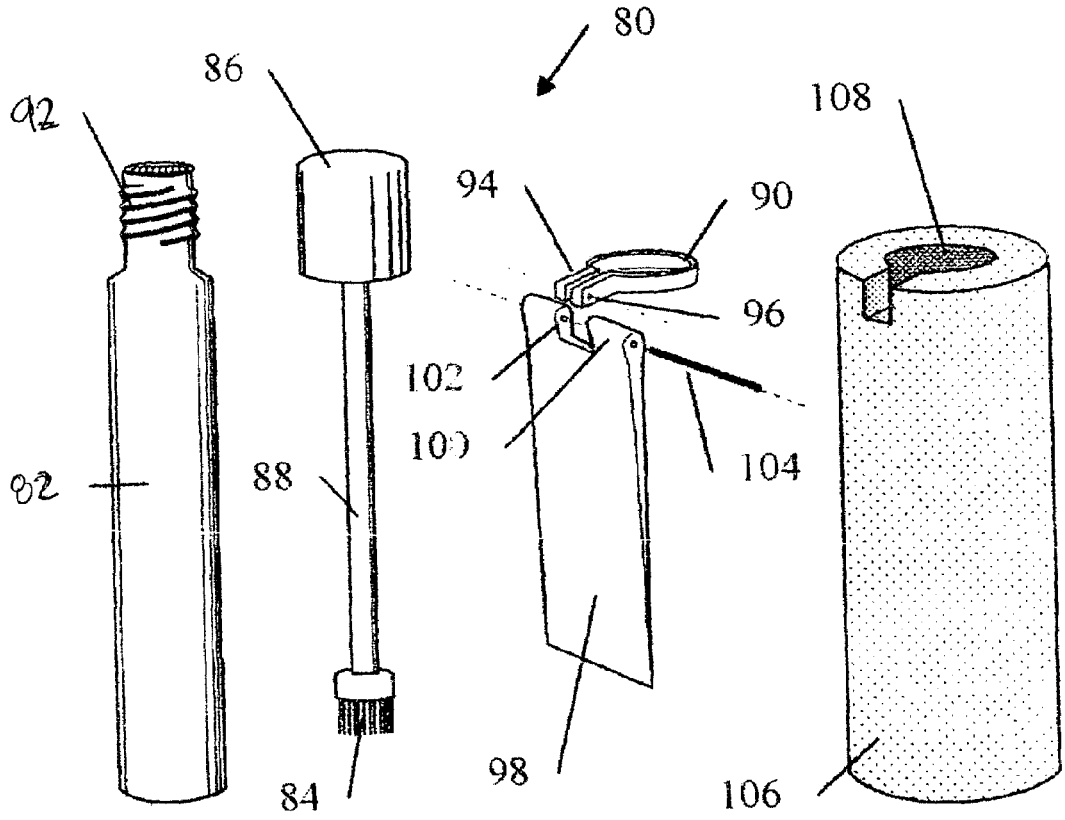
FIG. 7 is an exploded, perspective view of the stain removal kit of FIG. 6.

FIGS. 6 and 7 depict another embodiment of a stain removal kit 80 made in accordance with the present invention. Referring briefly to FIG. 7, this kit 80 includes a cylindrical container 82, which houses the stain remover. The container 82 also houses the stiff-bristled brush 84 when the brush 84 is not in use. The brush 84 is attached to the lower end of a stem 88, and a cap 86 is attached to the upper end. The cap 86 seals off the container 82 when the stem 88 and brush 84 are inside the container 82 and the cap 86 is threaded onto the neck 92 of the container 82. A collar 90 fits over the container 82. Extensions 94 on the collar 90 define aligned through-openings 96. A spatula 98 includes extensions 100 which are designed to straddle the extensions 94 of the collar 90. Holes 102 in the spatula extensions 100 align with the through-openings 96 in the collar extensions 94 to receive a hinge pin 104, which pivotably secures the spatula 98 to the collar 90. A sleeve 106, made from an absorbent material, defines an interior cavity 108, which is sized to substantially enclose the cylindrical container 82. In this case, the container 82 and cap 86 serve as a housing, which contains or supports the elements of the kit.

As may be appreciated from FIG. 6, the spatula 98 is normally in the stowed or retracted position (shown in solid), but may be swung to the extended position (shown in phantom) for use. Similarly, the brush 84 is normally stowed inside the cylinder 82, with the cap 86 sealing off the stain remover inside the cylinder 82. During use, the cap 86 is unthreaded from the neck 92 of the container 82 so that the stain remover may be applied to the stain, either by pouring the stain remover directly onto the stain or by applying it with the brush 84. The brush 84 then is used to scrub the affected area, and, finally, the absorbent-material sleeve 106 is used for final clean-up of the treated area.

Figure 8:
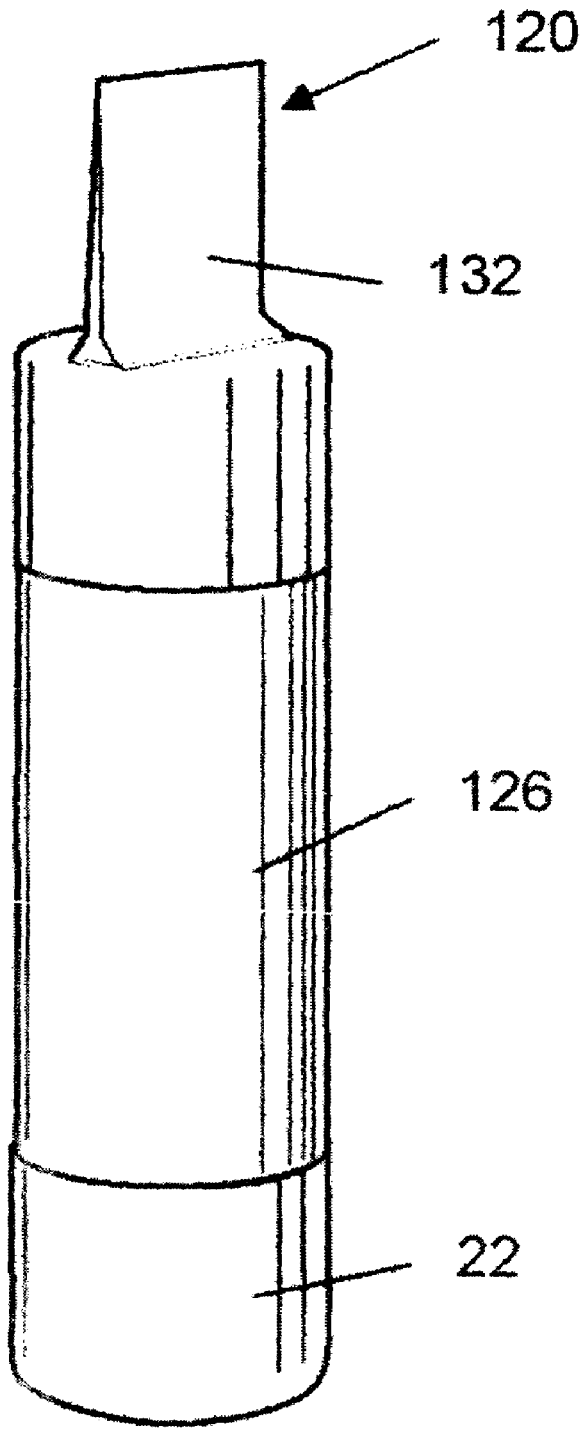
FIG. 8 is a perspective view of another embodiment of a stain removal kit made in accordance with the present invention.
Figure 9:
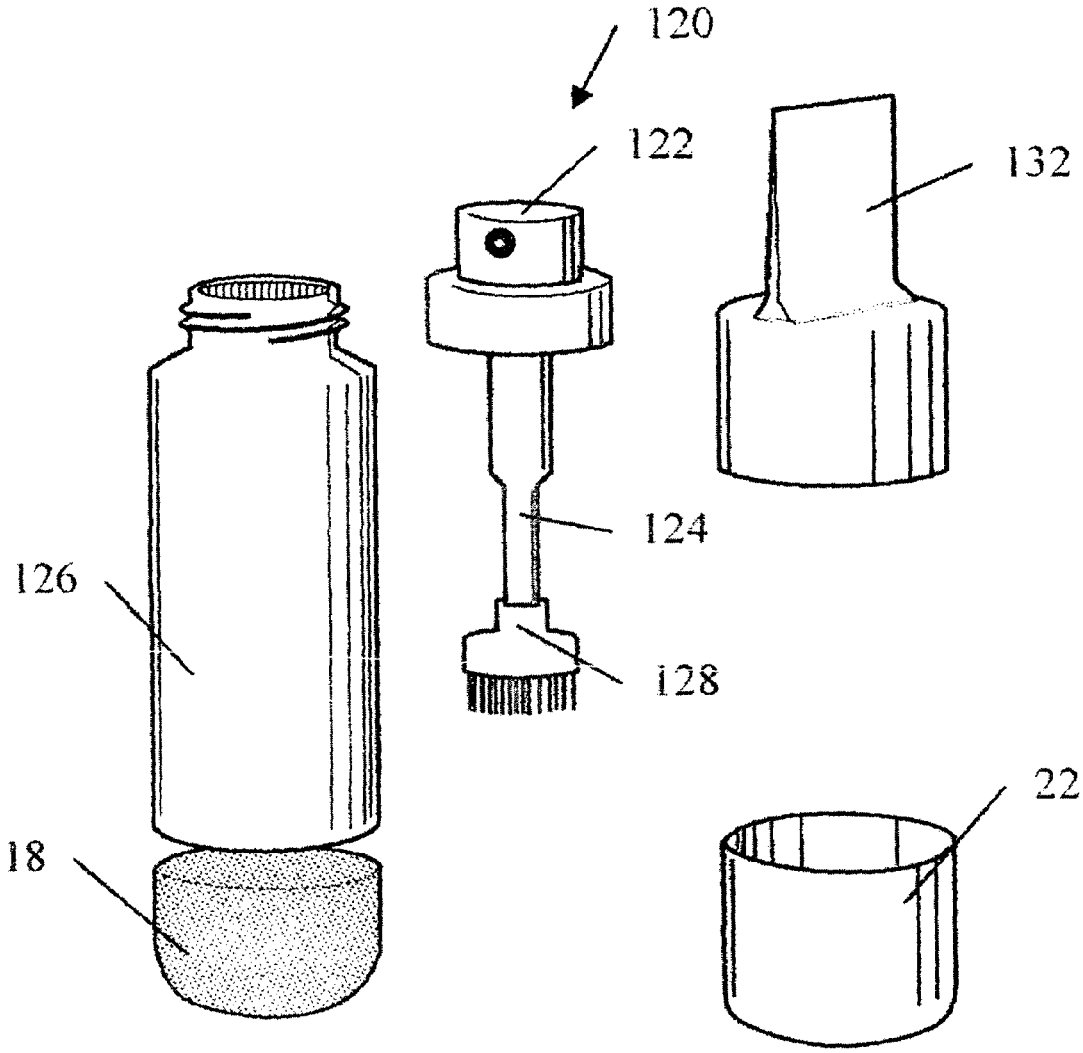
FIG. 9 is an exploded, perspective view of the stain removal kit of FIG. 8.

FIGS. 8 and 9 depict another embodiment of a stain removal kit 120 made in accordance with the present invention. As may be appreciated by comparing the FIGS. 8 and 9 against the FIGS. 1 and 2, these embodiments 120, 10 are very similar. The most significant difference is that the stain removal kit 120 includes an aerosol pump 122 to atomize the detergent stain remover directly onto the soiled area to be cleaned.

The aerosol pump 122 includes a stem 124 which houses the plunger mechanism used to suction out the detergent stain remover out of the cylindrical container 126, as is well known in the industry. The stiff-bristled brush 128 is attached to the end of the stem 124. The through opening 130 (See FIG. 10) allows fluid communication of the detergent stain remover from the inside of the container 126, through the stem 124 and to the aerosol pump 122.

A spatula 132 snaps over (or is otherwise secured to) the aerosol pump 122 to protect the pump 122 and prevent accidental pumping of the detergent/stain remover. As in the case of the first embodiment 10, the lower cap 22 snaps over (or is otherwise secured to) the absorbent material 18.

To use this stain removal kit 120, any excess stain is first removed using the spatula 132. The spatula 132 is then removed from the kit 120 and the aerosol pump is used to atomize a fine spray of the detergent/stain remover directly onto the soiled area to be cleaned. The aerosol pump 122 is then removed from the container 126 to expose the stiff-bristled brush 128, which is used to work the detergent/stain remover into the stain. The rest of the procedure is the same as has already been described with respect to the first embodiment 10.

Figure 10:
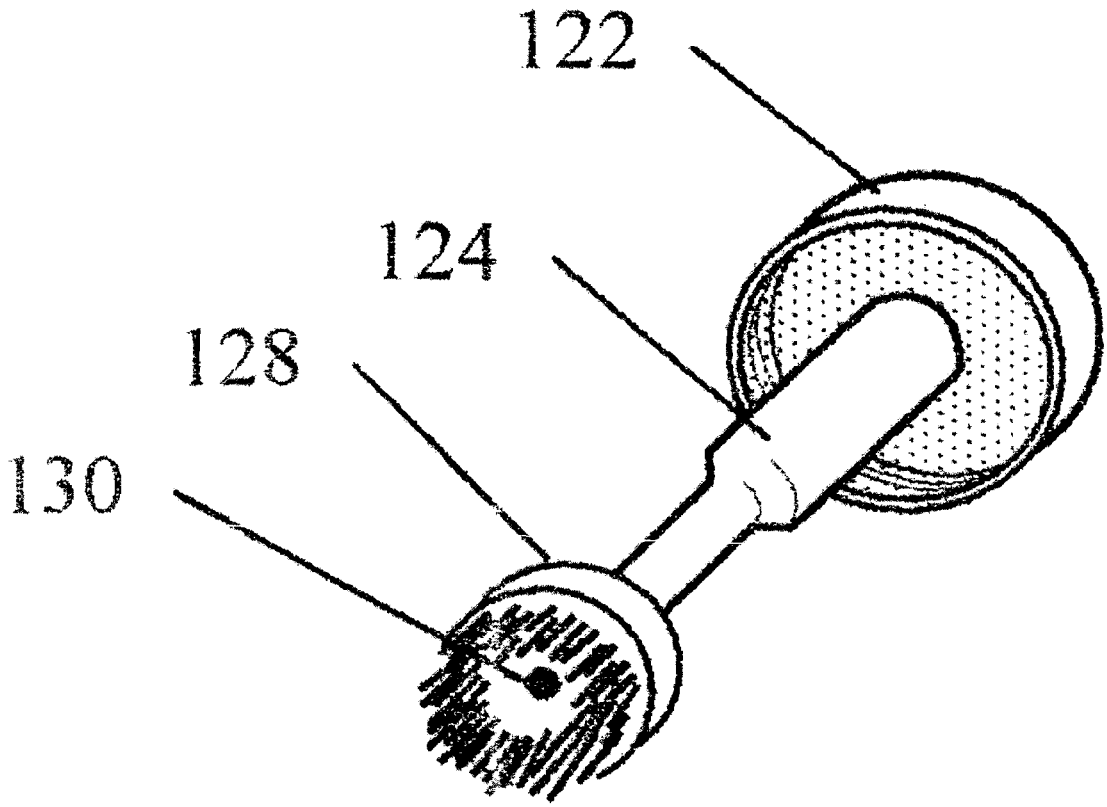
FIG. 10 is a detailed, perspective view of the aerosol pump and stiff-bristled brush of FIG. 9.

It should be noted that an aerosol pump 122 is shown in FIGS. 9 and 10. However, the detergent/stain remover could be packaged under pressure with a gaseous propellant for release as a spray of fine particles. In this instance, the brush 128 would be placed elsewhere so as to make it available for use without having to open the container 126 releasing its pressurized gaseous propellant. For example, the brush 128 could then be placed on the outside of the lower cap 22.

In the embodiment of FIG. 2, the means for dispensing the stain remover material includes opening the cap 32 and passing the stain remover material through the opening at the top end 16 of the housing 12. As explained earlier, the stain remover material may be applied directly to the fabric or it may be carried through the opening and applied to the fabric by the brush. The mounting means for keeping the absorbent material 18 out of contact with the stain remover material as the stain remover material is being dispensed includes securing the absorbent material 18 to the outside of the housing 12 and enclosing it with the cover 22.

In the embodiment of FIG. 4, the means for dispensing the stain remover material from the housing includes opening the blister package housing 44, removing the absorbent swab 54 or 60 that is impregnated with stain remover, and rubbing it onto the fabric. The mounting means which keeps the first absorbent material out of contact with the stain remover as it is being dispensed is mounting the other absorbent swab 54 or 60 that is not impregnated with stain remover on a separate elongated member 46, 48 from the one that is impregnated with stain remover, so it is out of contact with the stain remover as the stain remover is being dispensed.

In the embodiment of FIG. 5, the means for dispensing the stain remover from the housing includes opening the lid 74, putting one of the tips of the cotton swab 64 into the stain remover 70, then contacting the fabric with that tip. The mounting means for keeping the first absorbent material out of contact with the stain remover material as it is being dispensed is mounting the first absorbent material at the other end of the cotton swab 64.

In the embodiment of FIG. 7, the means for dispensing the stain remover material is the same as in the embodiment of FIG. 2. The mounting means for mounting the first absorbent material to keep it out of contact with the stain remover material as it is being applied is mounting the sleeve made of absorbent material 106 on the outside of the container 82.

In the embodiment of FIG. 9, the means for dispensing the stain remover material is the same as in the embodiment of FIG. 2, plus it includes a spray mechanism 122. The mounting means for mounting the first absorbent material to keep it out of contact with the stain remover material as it is being dispensed is the same as in the embodiment of FIG. 2.

While the embodiments described above show some examples of stain removal kits in accordance with the present invention, it will be obvious to those skilled in the art that various modifications may be made to these kits without departing from the scope of the present invention.

What is claimed is:

1. A stain removal kit for removing stains from fabrics, comprising:

a housing;

a spatula, a stain remover material, a brush, and a first absorbent material secured together by said housing;

means for dispensing said stain remover material from said housing; and mounting means which mounts said first absorbent material so as to keep the first absorbent material out of contact with said stain remover material as said stain remover material is being dispensed from said housing.

2. A stain removal kit for removing stains from fabrics as recited in claim 1, wherein said stain remover material is a liquid and said housing includes a container having an external surface and defining an internal chamber which contains said liquid.

3. A stain removal kit for removing stains from fabrics as recited in claim 2, wherein said first absorbent material is secured to the external surface of said container.

4. A stain removal kit for removing stains from fabrics as recited in claim 3, wherein said first absorbent material substantially encloses said container.

5. A stain removal kit for removing stains from fabrics as recited in claim 2, wherein said container defines an opening to said internal chamber, and further comprising a first cap, which releasably closes said opening.

6. A stain removal kit for removing stains from fabrics as recited in claim 5, wherein said first cap further comprises an aerosol pump to atomize said stain remover material and expel it from said internal chamber.

7. A stain removal kit for removing stains from fabrics as recited in claim 5, wherein said brush is attached to said first cap such that said brush lies inside said internal chamber when said first cap closes said opening.

8. A stain removal kit for removing stains from fabrics as recited in claim 7, wherein said spatula is attached to said first cap.

9. A stain removal kit for removing stains from fabrics as recited in claim 7, wherein said spatula is hingedly secured to said external surface of said container.

10. A stain removal kit as recited in claim 2, wherein said mounting means mounts said first absorbent material in contact with said container.

11. A stain removal kit for removing stains from fabrics as recited in claim 1, and further comprising a second absorbent material, wherein said stain remover material is impregnated into said second absorbent material.

12. A stain removal kit for removing stains from fabrics as recited in claim 1, wherein said housing defines a recess, and said stain remover material is a solid, which is stored in said recess.

13. A stain removal kit for removing stains from fabrics as recited in claim 1, wherein said first absorbent material is a cotton swab.

14. A stain removal kit for removing stains from fabrics as recited in claim 1, wherein said first absorbent material is a sponge.

15. A stain removal kit for removing stains from fabrics as recited in claim 1, wherein said stain remover is impregnated into a second absorbent material.

16. A stain removal kit for removing stains from fabrics as recited in claim 15, wherein said housing is a blister package.

17. A stain removal kit for removing stains from fabrics as recited in claim 16, when said second absorbent material housed in said blister package.

* * * * *

UNITED STATES PATENT AND TRADEMARK OFFICE

CERTIFICATE OF CORRECTION

PATENT NO. : 7,303,347 B1
APPLICATION NO. : 10/679877
DATED : December 4, 2007
INVENTOR(S) : Georgetta P. Duncan It is certified that error appears in the above-identified patent and that said Letters Patent is hereby corrected as shown below:

Claim 17 should read: A stain removal kit for removing stains from fabrics as recited in claim 16, [when said] wherein said second absorbent material is housed in said blister package.

Signed and Sealed this

Eighth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,303,347 B1
APPLICATION NO. : 10/679877
DATED : December 4, 2007
INVENTOR(S) : Georgetta P. Duncan It is certified that error appears in the above-identified patent and that said Letters Patent is hereby corrected as shown below:

Column 6, lines 53-55, Claim 17 should read: A stain removal kit for removing stains from fabrics as recited in claim 16, [when said] <u>wherein said</u> second absorbent material <u>is</u> housed in said blister package.

This certificate supersedes the Certificate of Correction issued April 8, 2008.

Signed and Sealed this

Sixth Day of May, 2008

JON W. DUDAS
*Director of the United States Patent and Trademark Office*